United States Patent [19]

Bauder

[11] Patent Number: 4,524,735

[45] Date of Patent: Jun. 25, 1985

[54] RECIPROCATING PISTON ENGINE

[75] Inventor: Armin Bauder, Neckarsulm, Fed. Rep. of Germany

[73] Assignee: Audi AG, Neckarsulm, Fed. Rep. of Germany

[21] Appl. No.: 652,103

[22] Filed: Sep. 19, 1984

[30] Foreign Application Priority Data

Sep. 21, 1983 [DE] Fed. Rep. of Germany ..... 3334044

[51] Int. Cl.[3] ..... F01M 1/00

[52] U.S. Cl. ..... 123/196 R; 123/198 E; 184/11.4; 184/13.1; 184/106

[58] Field of Search ..... 123/196 R, 196 S, 198 E, 123/195 C; 184/106, 13.1, 11.4

[56] References Cited

U.S. PATENT DOCUMENTS 1,569,404 1/1926 Smith ..... 184/6.27

2,093,570 9/1937 Meyer ..... 184/13.1

4,270,497 6/1981 Valerio ..... 123/195 C

FOREIGN PATENT DOCUMENTS 1948186 4/1971 Fed. Rep. of Germany ... 123/196 R

*Primary Examiner*—E. Rollins Cross

*Attorney, Agent, or Firm*—Kane, Dalsimer, Kane, Sullivan and Kurucz

[57] ABSTRACT

In a reciprocating piston combustion engine, an insert extends substantially to the plane separating the leading part of the oil pan from the interior of the crankcase. The free longitudinal edge of the insert is disposed above the oil level in the oil pan. Recesses in the insert receive oil that drips down from the crankshaft bearing and directs it back to the oil pan. In view of the close proximity of the recesses with the movement of the crank web, very little oil reaches the insert.

5 Claims, 5 Drawing Figures

RECIPROCATING PISTON ENGINE

In a known combustion engine of this type (DE-OS No. 19 48 186), an insert extends from the connecting path of the connecting rod from a longitudinal edge of the lower opening of the cylinder crank housing to the other longitudinal edge of the lower opening of the cylinder crank housing; and, it is also provided with openings adjacent these two longitudinal edges, so that the oil which is taken along by the parts of the rotating crank shaft flows downwardly in the space between the insert and the oil pan. Despite the fact that the insert is adjusted to the path of movement of the connecting rod and oil can collect in the lower area into which the connecting rod heads preimmerse, because of the upper positions of the opening in the insert, oil waste occurs despite the insert.

It now has been determined that even with reciprocating piston-combustion engines, wherein the oil level in the oil pan is normally disposed below the movement paths of the connecting rod heads and the crank web, considerable losses occur due to the oil loss. A test of this phenomenon showed that the air in the crank case is taken along by the rotation of the crank shaft, the connecting rod heads and the crank webs, thus resulting in increased speed in the crank shaft in the rotational direction of the crank shaft. A dynamic pressure is generated by this rotating air which acts on the oil in the oil pan and displaces this oil in the rotational direction of the crank shaft, so that it reaches the area of movement of the connecting rod heads and the crank webs. The insert of DE-OS No. 19 48 186 cannot prevent this displacement of oil, since the dynamic pressure can act through the openings at the one side of the insert on the oil in the lower disposed oil pan; and, the area of the openings on the other side of the insert suction is generated by the vortex which supports the transmition of oil from these openings into the area of movement of the connecting rod heads and the crank webs.

It is an object of the invention to reduce, in a reciprocating piston-combustion engine of the foregoing type, the immersion of the connecting rod heads and the crank webs into the oil, and, thereby, the capacity loss is held to a minimum with the least amount of effort.

This object of the invention is solved in that the insert extends from the longitudinal edge of the bottom opening which lies in the direction of the bottom opening, which in turn lies in the direction of rotation of the crank shaft behind the plane comprising the cylinder axes, in a direction opposite the direction of rotation without interruption substantially up to the plane separating the leading portion of the oil pan from the interior of the crankcase.

In accordance with the invention displacement of the oil is prevented in the area of the connecting heads and crank webs in the oil pan by means of the dynamic pressure by the previously mentioned vortex.

Preferably, the insert extends substantially to the plane containing the cylinder center axis, whereby its free longitudinal edge is above the oil level in the oil pan. The insert is provided with recesses below the crank shaft bearing, whose side wall extend close to the movement of the adjacent crank webs and whose deepest location is provided at the free longitudinal edge of the insert. Accordingly, about half of the injection oil which discharges from the crank shaft bearings can reach the oil pan directly, while the other half drips down to the recesses provided immediately below the crankshaft bearing and can flow from there to the oil pan. Since the sidewalls shift these recesses close to the operating movement of the crank webs, only very little oil can reach the insert in which the crank webs and the connecting rod heads circulate.

In order to assure that distance is constantly provided between the free longitudinal edge of the insert and the oil level which will adjust during operation, thus preventing overflow of oil from the oil pan into the insert, it is essential to adjust the insert in cross-section, at least at its rear in a rotational direction, so as to accommodate the path of movement of the crank webs and the connecting rod heads, namely, to shape it in the form of a quadrant, so that the oil displaced in the crankshaft can increase behind or below the insert during acceleration, during driving up a mountain as well as during the air movement, so that the oil level is reduced in the area of the free longitudinal edge of the insert.

In order to increase the stability of the insert, it can extend from one longitudinal edge of the lower opening to the other, such that in the area of the longitudinal edge of the lower opening of the cylinder crankshaft following the rotational direction of the crank shaft and the plane containing the cylinder center axis, openings are provided for the discharge of the oil from the crankshaft bearings into the lower positioned oil pan.

One exemplified embodiment of the invention with one deviation is described in the following in relation to the drawings. The drawings show:

Figure 1:
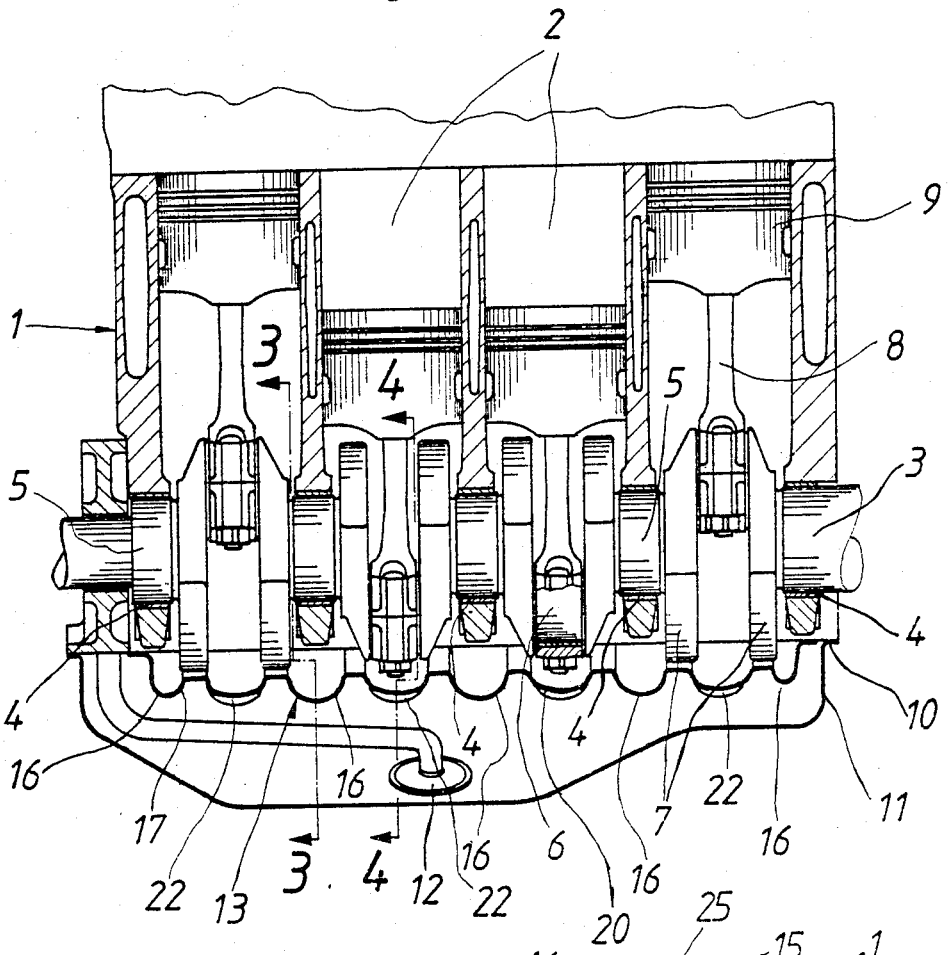
FIG. 1 is a cross-sectional view of a cylinder crank housing of a reciprocating combustion engine with flanged oil pan.

A cylinder crankshaft 1 is shown in FIG. 1 having a plurality of cylinder bores 2 in which a crankshaft 3 is mounted by means of bearings 4. The crankshaft 3 is composed of the base bearing pins 5 mounted in the bearings 4, the connecting rod bearing pins 6 disposed between the adjacent base bearing pins 5 and the crank webs 7 which connect the connecting rod pins 6 with the base bearing pins 5 in the form of balancing weights. The number of the connecting rod pins 6 corresponds to the number of cylinder bores 2 and each connecting rod pin 6 is connected with a reciprocating piston 9 by means of a connecting rod 8 and an associated cylinder bore 2.

Figure 3:
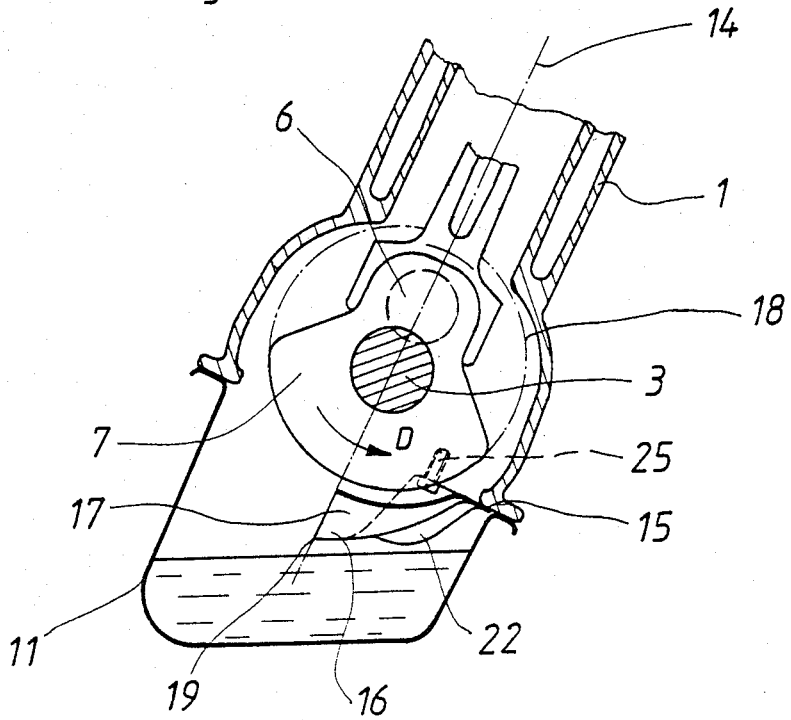
FIG. 3 is a sectional view along the line 3—3 in FIG. 1.

The cylinder crankshaft housing 1 is open at its bottom and its lower opening 10 is closed by a flanged oil pan 11. In usual manner, a suction basket 12 of a lubricating pump is connected to the oil pan. An insert 13 is provided between the crankshaft 3 and the bottom of the oil pan 11 which essentially extends throughout the total length of the lower opening 10 of cylinder crankshaft housing 1, as can be seen in particular in FIGS. 3 and 4, looking at plane 14 in which the cylinder axes are disposed in rotational direction D of crankshaft 3, up to the corresponding longitudinal edge 15 of the lower opening 10 of the cylinder shaft housing 1. The insert 13 is provided with recesses 16 below crankshaft bearing 4, whose side walls 17 extend in proximity to the operating movements 18 of crank webs 7 and run parallel thereto, as can be seen from FIG. 3. The deepest location 19 of each recess is positioned on the free longitudinal edge 20 of insert 13. The insert 13 is adjusted between the recesses 16 with its rear area in the rotational direction D very close to the operating path 21 (connecting rod movement) of connecting rod 8 or the connecting rod heads 8*a*, as can be seen from FIG. 4. Thereby pockets 22 are created between adjacent recesses 16. The free edge 20 of the insert 13 is within pockets 22 and at such a distance from the oil level 23 that under no circumstances can oil flow from the oil pan 11 into pockets 22, and the pockets are deep enough so that no oil can collect therein.

The injected oil which discharges from the crankshaft bearings 4 can reach the oil pan 11 directly through the area of the lower opening 10 of the cylinder housing 1 which is not covered by insert 13. The remainder of the injected oil flows into the recesses 16 and can flow from there into the oil pan 11, since its deepest location 19 is disposed at the free edge 20. The inclination of the bottom of the recesses 19 with respect to the horizontal may be about 3° . Since the lateral limiting walls 17 of recesses 16 extend closely to the operating cycle 18 of the crank webs 7, only a very low amount of oil can reach the are of movement of the crankshaft 7 and into pockets 22. The small amount of oil which can collect in the pockets 22 is taken along with the connecting rod heads 8*a* and centrifuged into the oil pan 11. If need be, a discharge bore may be provided at the deepest position of each pocket 22. The insert above all, prevents oil from being displaced into the right part of the oil pan 11 as viewed in FIGS. 3 and 4 due to the rotating movement of crank shaft 3, and, prevents the oil from being displaced by the rotating movement of crankshaft 3 from oil pan 11 in the rotation D of the crank shaft.

Figure 4:
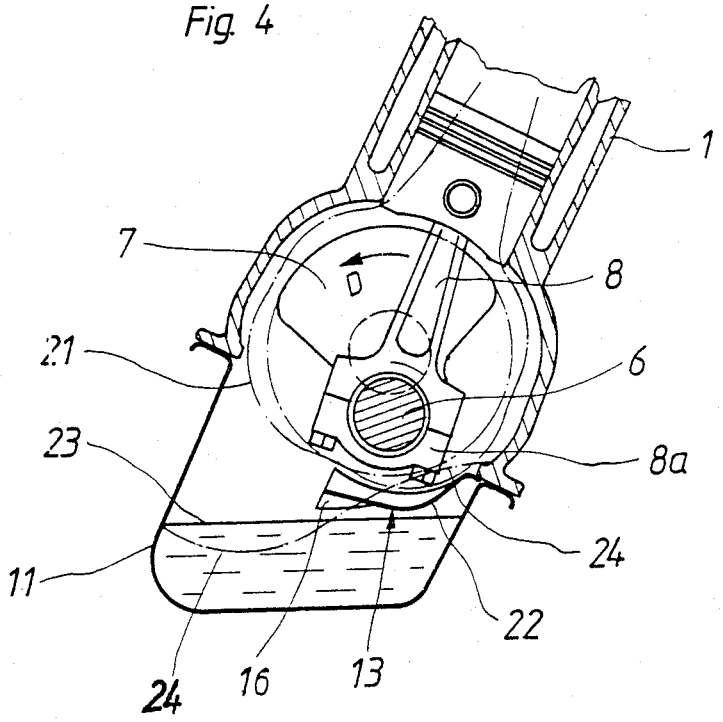
FIG. 4 is a sectional view along line 4—4 in FIG. 1.

Without the insert 13, one would obtain the oil level 24 shown in dot-dash lines in FIG. 4, whereby the connecting rod heads 8*a* would immerse in the oil. This is effectively avoided by the insert 13. Due to the adjustment of insert 13 to the operational paths 18 or 21 of the crank webs 7 and the connecting rod 8 or the connecting rod heads 8*a* at the rear area in the rotational direction D, the oil displaced thereby can increase under the insert 13, whereby the oil level is lowered in the area of the free edge 20 of the insert 13, so that the protection against overflow of oil into pockets 22 is increased, and in particular the free edge 20 is very deep in the area of pockets 22, so as to keep the oil level as low as possible in the pockets 22. The insert 13 also prevents oil reaching the area of movement of the connecting rod or the connecting rod head heads in the driving direction behind the cylinder during ascending movements and during aceleration.

The insert 13 may consist of sheet metal or plastic and is screwed onto the lower side of the cylinder crank housing 1 by means of screws 25.

Figure 2:
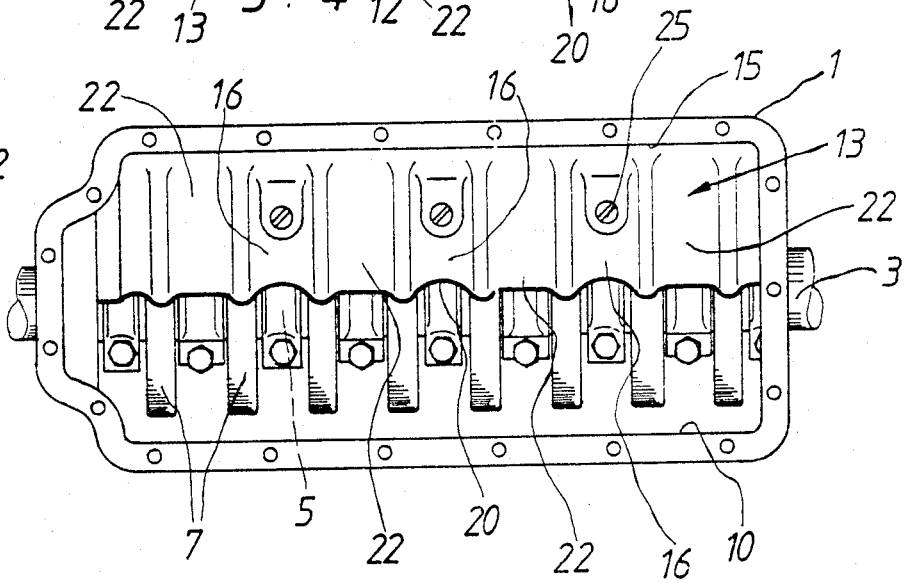
FIG. 2 is a view of the cylinder crank housing of FIG. 1 from below, with the oil pan omitted.
Figure 5:
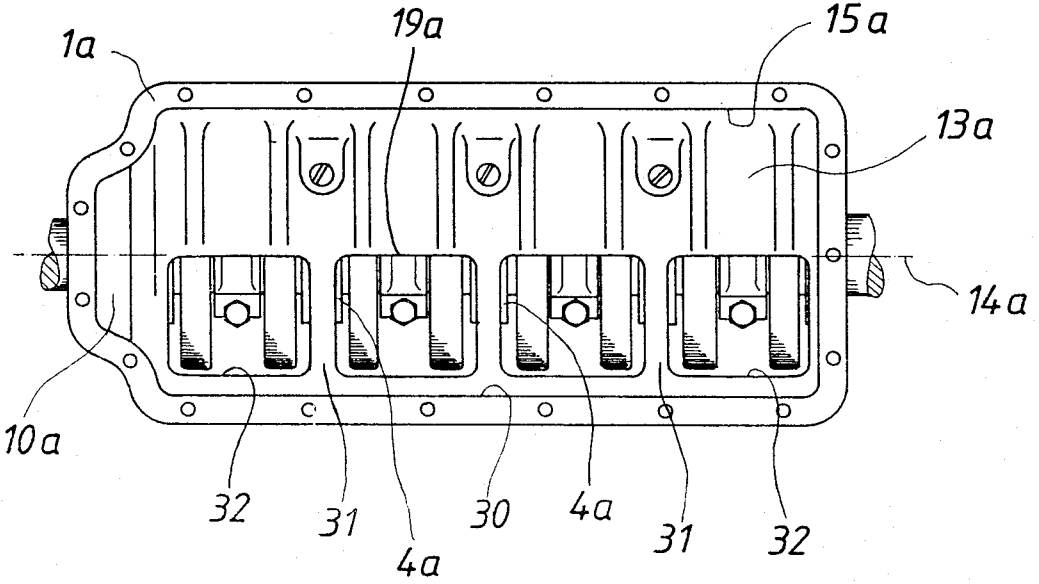
FIG. 5 is a view similar to FIG. 2 with a different insert.

The alternate embodiment of FIG. 5 differs from the one of FIG. 2 essentially only in that the insert 13*a* extends from the one longitudinal edge 15*a* to the other longitudinal edge 30 of the lower opening 10*a* of the cylinder crank housing 1*a* and is provided with openings 32 for the discharge of oil from the crank shaft bearings 4*a* into the lower positioned oil pan in the area between the longitudinal edge 30 and the cylinder center axis plane 14*a*. The ribs 31 which are formed thereby stiffen the longitudinal edge 19*a* and prevent a vibration thereof during operation. Preferably, the ribs 31 are mounted in the same plane of the crankshaft bearing 4*a*, however, they are considerably smaller, so that the oil discharge is not prevented by these ribs 31.

I claim:

1. Reciprocating piston engine, in particular for motor vehicles, comprising a cylinder-crankcase (1) with a plurality of cylinders (2) having central axes which lie in a common plane (14), a crankshaft (3) supported by bearings (4) within said crankcase, said crankshaft comprising crank pins (6) and crank webs (7), said crankcase having a bottom opening (10) with longitudinal edges extending parallel to the crankshaft, said opening (10) being closed by an oil pan (11), and further comprising an insert (13) between the crankshaft and the bottom of the oil pan, said insert extending substantially over the whole length of the said bottom opening, characterized in that said insert (13) extends from that longitudinal edge (15) of said bottom opening (10), which lies in the direction of rotation (D) of the crankshaft (3) behind the plane (14) comprising the cylinder axes in opposite direction to said direction of rotation (d) without interruption substantially up to said plane (14) to separate the leading portion of the oil pan from the interior of the crankcase.

2. Reciprocating piston engine according to claim 1, wherein said insert (13) extends substantially up to said plane (14) only, whereby a free edge (20) is formed which lies above the oil level within the oil pan (11), said insert (13) having depressions (16) underneath the crank bearings (4), said depressions (16) having side walls (17) which extend close to the paths of the adjacent crank webs (7), whereby the deepest spot (19) of the depressions (16) lies on the free edge (20) of the insert (13).

3. Reciprocating piston engine according to claim 2, wherein said insert (13) closely matches the paths (22) of the connecting rods (8) between adjacent depressions (16).

4. Reciprocating piston engine according to claim 1, wherein said insert (13*a*) extends from one longitudinal edge (15) of said bottom opening (10*a*) to the other longitudinal edge (30), and wherein openings (32) are provided in the region between the trailing edge (30) and the plane (14*a*) containing the cylinder axes, so that oil from the crank bearings (4*a*) can drip into the oil pan.

5. Reciprocating piston engine according to claim 1 or 4, wherein said insert is screwed to the crankcase along the respective longitudinal edge(s) (15, 15*a*, 30) of the bottom opening (10, 10*a*) thereof.

* * * * *